US011136052B2

(12) United States Patent
Mousset

(10) Patent No.: US 11,136,052 B2
(45) Date of Patent: Oct. 5, 2021

(54) CABLE ASSEMBLY FOR PROVIDING A DATA ACQUISITION SYSTEM WITH DATA MESSAGES PASSING ON A FIELDBUS OF ROLLING STOCK

(71) Applicant: RAILNOVA SA, Saint-Gilles (BE)

(72) Inventor: Charles-Henri Mousset, Watermael Boitsfort (BE)

(73) Assignee: RAILNOVA SA, Saint-Gilles (BE)

( * ) Notice: Subject to any disclaimer, the term of this patent is extended or adjusted under 35 U.S.C. 154(b) by 0 days.

(21) Appl. No.: 16/636,998

(22) PCT Filed: Jul. 19, 2018

(86) PCT No.: PCT/EP2018/069651
§ 371 (c)(1),
(2) Date: Feb. 6, 2020

(87) PCT Pub. No.: WO2019/029970
PCT Pub. Date: Feb. 14, 2019

(65) Prior Publication Data

US 2020/0239048 A1 Jul. 30, 2020

(30) Foreign Application Priority Data

Aug. 8, 2017 (EP) ..... 17185376

(51) Int. Cl.
*B61L 15/00* (2006.01)

(52) U.S. Cl.
CPC ..... *B61L 15/0036* (2013.01); *B61L 15/0081* (2013.01)

(58) Field of Classification Search
CPC ..... G06F 13/36; G06F 13/38; G06F 13/385; G06F 13/4004; G06F 13/4063; G06F 13/4072; B61L 15/0036; B61L 13/0081
See application file for complete search history.

(56) References Cited

U.S. PATENT DOCUMENTS 10,552,879 B1 * 2/2020 Hardiman ..... G06Q 30/0278
2006/0155908 A1 * 7/2006 Rotvoid ..... H04L 25/0266 710/315

(Continued)

FOREIGN PATENT DOCUMENTS

CN 101083590 A 12/2007
CN 103368649 A 10/2013

(Continued)

OTHER PUBLICATIONS

"D-Subminiature Connectors; Technical data", DELTRON, Mar. 31, 2014, retrieved from https://www.deltron.ch/downloads/dl/file/id/42/d_sub_standard_technische_daten.pdf, retrieved on Jan. 27, 2020, p. 27.

(Continued)

*Primary Examiner* — Raymond N Phan
(74) *Attorney, Agent, or Firm* — Workman Nydegger

(57) ABSTRACT

A cable assembly for providing a data acquisition system with data messages passing on a fieldbus of rolling stock, said cable assembly comprising a data listener adapted to listen in on said data messages passing on said fieldbus; a data transmitter adapted to transmit said data messages to said data acquisition system; and an isolation module adapted to electrically isolate said data transmitter from said data listener and from said fieldbus, thereby electrically isolating said data acquisition system from said fieldbus such that said data acquisition system is limited by said isolation module to only listening in on said data messages passing on said fieldbus.

12 Claims, 1 Drawing Sheet

(56) References Cited

U.S. PATENT DOCUMENTS

2008/0042015 A1* 2/2008 Plawecki ..... B61L 3/125 246/122 R
2008/0231578 A1 9/2008 Johnson et al.
2009/0315395 A1* 12/2009 Rogoll ..... H04L 12/40189 307/23
2010/0216343 A1* 8/2010 Buschnakowski ..... G08C 17/06 439/620.01
2013/0088092 A1* 4/2013 Ladron de Guevara ..... H01G 4/385 307/109
2014/0232369 A1* 8/2014 Hogan ..... H04L 25/0268 323/355
2014/0253008 A1* 9/2014 Sykes ..... H02P 3/02 318/494
2015/0222241 A1* 8/2015 Brudermann ..... H03H 7/004 375/256
2016/0274921 A1* 9/2016 Walker ..... H04B 3/28
2016/0359741 A1 12/2016 Cooper et al.
2017/0024586 A1* 1/2017 Aldrian ..... G06F 21/78
2017/0250734 A1* 8/2017 Cherewka ..... H04B 3/56
2019/0109726 A1* 4/2019 Pohl ..... H04L 12/40

FOREIGN PATENT DOCUMENTS

CN 103543680 A 1/2014
EP 1702408 A1 9/2006
EP 3150460 A1 4/2017
WO 2015088887 A1 6/2015

OTHER PUBLICATIONS

International Search Report and Written Opinion from International Application No. PCT/EP2018/069651, dated Oct. 23, 2018.
European Search Report and Written Opinion from Application No. EP17185376.5, dated Feb. 26, 2018.
"IEEE Standard for Layer 2 Transport Protocol for Time-Sensitive Applications in Bridged Local Area Networks," IEEE Computer Society, May 6, 2011, 57 Pages.
Chinese Office Action from corresponding CN Application No. CN20180051239.8, dated May 14, 2021.

* cited by examiner

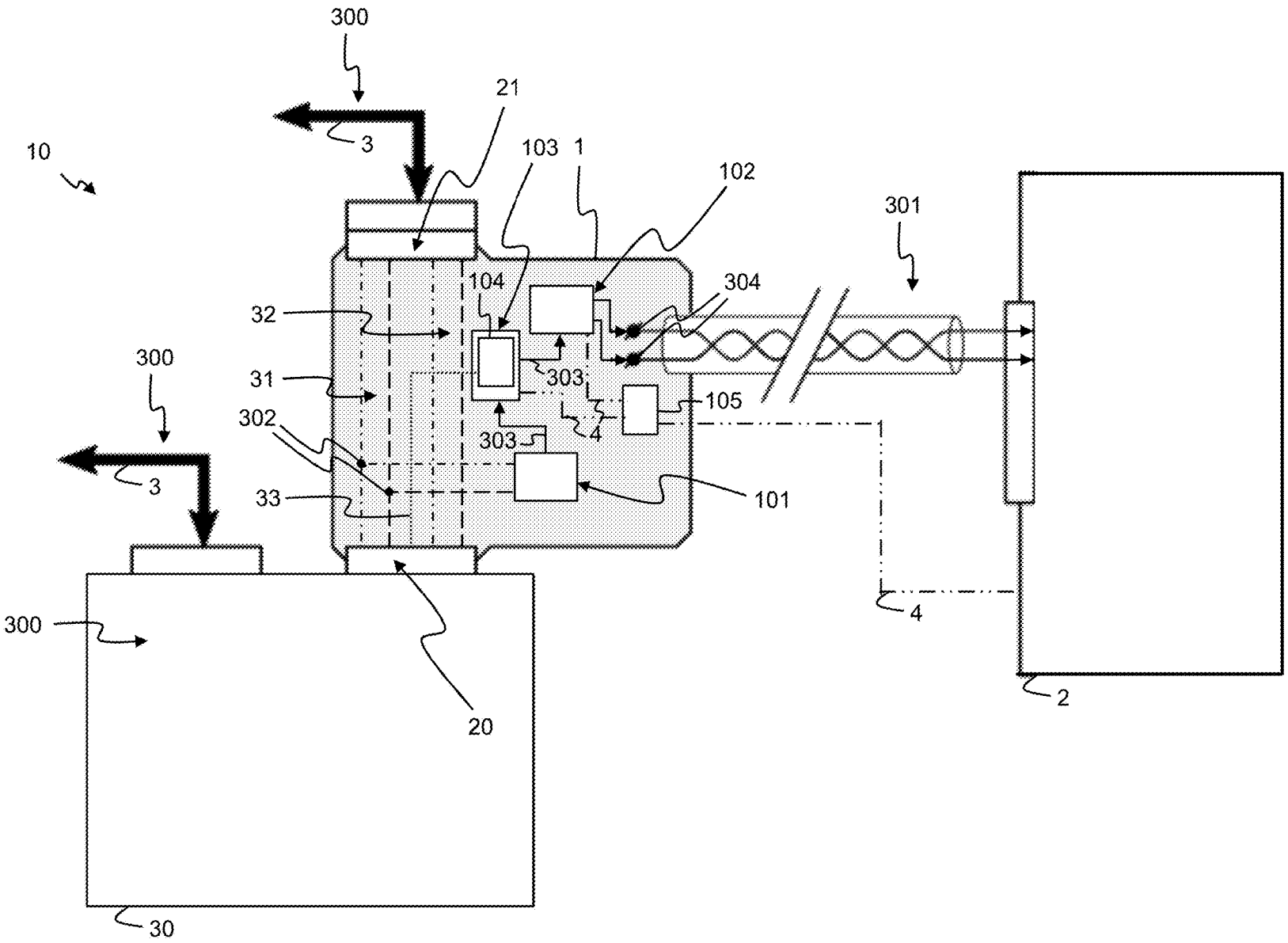
2
4
301
101
102
304
105
1
4
303
103
303
21
104
20
300
3
32
31
302
33
300
3
30
10
300

CABLE ASSEMBLY FOR PROVIDING A DATA ACQUISITION SYSTEM WITH DATA MESSAGES PASSING ON A FIELDBUS OF ROLLING STOCK

FIELD OF THE INVENTION

The present invention generally relates to remote and fail-safe monitoring and diagnostic of railway assets and components on board rolling stock.

BACKGROUND OF THE INVENTION

Rail plays an important role in creating a sustainable future for transport around the world. Rail transport may help tackle climate change, fight road congestion, create economic growth for a country, contribute to the (re-) industrialisation of this country, and provide mobility to citizens. Rolling stock is an essential item within the railway and transport systems, but it is also one of the most complex. The term rolling stock refers to any vehicle that moves on a railway. It usually comprises both powered and unpowered vehicles, for example locomotives, railroad cars, coaches, and wagons. From running gear through strength and durability, drives, brakes, regulation and control systems and up to fire protection and occupational health and safety, all safety-relevant functionalities of rolling stock must be in full working order at all times.

Nowadays, the monitoring of the performance of railway assets and components of rolling stock is planned regularly to detect and/or foresee a possible malfunction and/or a failure of each railway asset and/or component. Each fault, breakdown or failure of each railway asset or component is individually and independently detected for example by a handler of rolling stock on board the rolling stock. Each time a failure or a series of failures is identified, the rolling stock is brought to a workshop for in depth inspection and diagnostic and repair. Monitoring and/or diagnosing the performance of on board railway assets and components of rolling stock therefore requires temporary but repetitive immobilization throughout the year of the rolling stock. Bringing the rolling stock in for diagnosis and repair increases the downtime of the rolling stock, which is very inconvenient in the context of the management of a railway fleet.

Another concern in railway fleet management is that operators and maintainers face huge data complexity: each locomotive or railroad car comprises a different set of on board devices which can be each compatible with different fieldbus communication protocols developed for railway fleet, for example with a Multifunction Vehicle Bus also referred to as MVB, or a Factory Instrumentation Protocol also referred to as FIP, or a Profibus, or a Controller Area Network also referred to as CAN. Additionally, the set of on board devices varies from one locomotive or railroad car to another. For example, the locomotive Prima from Alstom comprises a Factory Instrumentation Protocol bus, also referred to as a FIP bus and a battery, while a Euro4000 locomotive from Stadler comprises an EMD engine, a battery, an EM 2000 and a fuel sensor.

Several challenges therefore remain today in accessing data from rolling stock. Operators and maintainers rely on a plurality of diagnostic PCs and on the availability of experts to perform maintenance on the rolling stock. Each diagnostic PC comprises expertise knowledge and is adapted to monitor and diagnose one component on board the locomotive or railroad car. In other words, to each type of component in the locomotive or railroad car corresponds a different diagnostic PC. This increases the complexity of accessing data from devices on board rolling stock. Additionally, this results in the creation of local and incomplete databases on each diagnostic PC which need to be manually exported afterwards by the operators and the maintainers, for example via USB sticks, etc. Detailed and reliable knowledge on the state of the locomotive or railroad car is therefore in first instance not widespread and cannot be shared. Accessing data from rolling stock is therefore not actionable, and usually happens too late. Indeed, an intervention of an expert to diagnose the cause of a failure of a component is planned after the failure has already happened. This is incompatible with the implementation of a real-time support for the driver of the locomotive or railroad car.

Accessing data from rolling stock nowadays further raises safety concerns. The entire system comprising the rolling stock must fulfil safety requirements according to both national and international standards and directives. The diagnostic PCs and the USB sticks used by operators and maintainers form an intrusion in the rolling stock system and threaten the integrity of the safety of the rolling stock. Indeed, running the software developed to test and diagnose original equipment in rolling stock can reset configurations of the fieldbus to which the equipment is coupled. There exists a risk that accessing data from rolling stock therefore jeopardizes the safety of the locomotive or the railroad car.

It is an objective of the present invention to disclose a cable assembly that overcomes the above identified shortcomings of existing solutions. More particularly, it is an objective to disclose a cable assembly that allows to safely access data from rolling stock to remotely monitor and diagnose performance of equipment on board rolling stock, thereby minimizing the downtime of the rolling stock.

SUMMARY OF THE INVENTION

According to a first aspect of the present invention, the above defined objectives are realized by a cable assembly for providing a data acquisition system with data messages passing on a fieldbus of rolling stock, the cable assembly comprising:

- a data listener adapted to listen in on the data messages passing on the fieldbus;
- a data transmitter adapted to transmit the data messages to the data acquisition system; and
- an isolation module, adapted to electrically isolate the data transmitter from the data listener and from the fieldbus, thereby electrically isolating the data acquisition system from the fieldbus such that the data acquisition system is limited by the isolation module to only listening in on the data messages passing on the fieldbus.

The cable assembly according to the present invention is interposed between one or more railway assets or components on board rolling stock and a data acquisition system also on board the rolling stock. In other words, the cable assembly is introduced on board the rolling stock between one or more devices on board a train and the train in order to covertly listen in on the communication passing on a fieldbus coupling a plurality of devices to the rolling stock. The installation of the cable assembly on board the rolling stock is easy as the cable assembly comprises a connector which must simply be plugged in on the fieldbus or on a device. There is no bandwidth limitation or data downsampling with the cable assembly according to the present invention and the dimensions of the connector of the cable assembly are kept short to minimize the impact of the cable assembly on the propagation time of the data messages. The isolation module of the cable assembly electrically isolates the data transmitter from the respectively the data listener and from the fieldbus. The cable assembly according to the present invention is then totally passive on the bus and collects an electronic copy of the data messages passing on the fieldbus without interfering with the data messages passing on the fieldbus. In other words, the cable assembly according to the present invention collects an electronic copy of the data messages passing on the fieldbus in a non-intrusive manner on the fieldbus without affecting the original data messages passing on the fieldbus and without affecting the characteristics or the configurations of the fieldbus themselves. The cable assembly then transmits the listened in data messages to the data acquisition system, for example over a high-speed data link. For example, the high-speed data link is 1.5 Mbps RS-485. Alternatively, the cable assembly transmits the listened in data acquisition system via Ethernet network. The data acquisition system is not able to write commands and/or send data messages on the fieldbus via the cable assembly. The cable assembly according to the present invention therefore protects the fieldbus and the coupled railway assets and devices from potential shortcuts, over voltages, pin reversing, etc. that would occur at the side of the data acquisition system. The cable assembly further complies with safety requirements according to both national and international standards and directives.

In other words, the isolation module of the cable assembly according to the present invention prevents the data transmitter from writing commands on the fieldbus and/or from sending or transmitting data messages or any other type of messages to the fieldbus. The isolation module of the cable assembly according to the present invention thereby prevents the data acquisition system from writing commands on the fieldbus and/or from sending or transmitting data messages or any other type of messages to the fieldbus. The cable assembly according to the present invention only intercepts data messages passing on a fieldbus without interfering with the fieldbus and without modifying either the data messages that are intercepted or the data messages passing on the fieldbus. In other words, the data messages that are read from the fieldbus by the cable assembly according to the present invention are not interfered with on the fieldbus. This way, the integrity of the data messages transmitted over the fieldbus remains. The isolation module of the cable assembly according to the present invention allows the data acquisition system to read the data messages passing on the fieldbus without interfering with the fieldbus and without modifying the data messages. In other words, the isolation module of the cable assembly according to the present invention allows the data acquisition system to receive the data messages from the fieldbus without interfering with the data messages passing on the fieldbus and without modifying the data messages passing on the fieldbus. In other words, the isolation module of the cable assembly according to the present invention allows the data acquisition system to monitor the data messages from the fieldbus without interfering with the data messages passing on the fieldbus and without modifying the data messages passing on the fieldbus. In other words, the isolation module of the cable assembly according to the present invention allows the data acquisition system to receive the data messages from the fieldbus without interfering with the data messages passing on the fieldbus and without modifying the data messages passing on the fieldbus, and the data messages still pass on the fieldbus as the data messages do not have the data acquisition system as destination.

This way, the cable assembly according to the present invention prevents any unwanted intrusion on the fieldbus. For example, the cable assembly according to the present invention prevents any unwanted hacking intruder on the fieldbus to write commands and/or to transmit and/or send data messages or any other type of messages on the fieldbus which could jeopardize the correct and safe functioning of the rolling stock and which could endanger the integrity of the rolling stock and/or of its load.

The cable assembly according to the present invention allows remote and real-time and fail-safe diagnostic of a condition of rolling stock. In particular the cable assembly according to the present invention allows remote and real-time monitoring of the performance of railway assets and components on board rolling stock, such as for example the battery monitoring system of a locomotive, and/or the bearing monitoring system of a locomotive or a railway car, and/or the Train Control & Management System of a train, also referred to as TCMS, and/or the engine remote diagnostic system of a locomotive, and/or the energy remote monitoring system of a train, etc. The data messages passing on the fieldbus comprise information indicative for a status of one or more of the devices coupled to the fieldbus. Thanks to the cable assembly, the monitoring of the performance of the devices and/or the diagnostic of the state of the devices on board rolling stock is performed continuously over time and can therefore be used to support for example a driver of a locomotive in real-time. This way, an accurate state of the rolling stock can be characterized by the data acquisition system and transient events occurring on board the rolling stock can be detected by the data acquisition system. The use of the cable assembly according to the present invention can therefore support an operator and/or a technician foresee a shortage or failure of one or more of the devices on board the train and/or can support the operator and/or the technician diagnose the shortage or failure. Additionally, as the cable assembly according to the present invention listens in on a fieldbus to which a plurality of devices is coupled, the cable assembly allows the data acquisition system to become one centralized Internet Of Things platform from which all the assets and components coupled to the fieldbus can be checked and characterized. This uniformed platform allows the centralization of the history of the monitoring and the diagnostic of the rolling stock, for example in the cloud, and renders accessing data from rolling stock widely accessible to operational staff and experts who can leverage themselves with data analysis software.

The cable assembly according to the present invention further comprises a power supply which is coupled to a power supply unit comprised in the data acquisition system. The power supply provides power to the data listener and the data transmitter of the cable assembly. For example, the power supply receives 5 Volts from the power supply unit of the data acquisition system. Alternatively, the power supply of the cable assembly according to the present invention receives power from a computer or a tablet or a phone or a laptop or a USB key.

The cable assembly according the present invention is compact and holds in a housing which does not modify the impedance of the fieldbus according to the specification. In other words, the cable assembly is integrated in a small and compact housing which is easy to assemble and easy to couple to the fieldbus. A small form factor is essential for preventing impact on the fieldbus.

The term rolling stock refers to any vehicle that moves on a railway. It usually comprises both powered and unpowered vehicles, for example one or more locomotives, one or more railroad cars, one or more coaches, and one or more wagons. In other words, rolling stock comprises engines and carriages that are used on a railway. In other words, rolling stock comprises one or more wheeled vehicles used on a railway, for example one or more locomotives and/or one or more passenger coaches and/or one or more freight wagons and/or one or more guard's vans, etc.

The data listener according to the present invention is for example a transformer such as for example the transformer ALT4532M-201-T001 from TDK adapted to receive the data messages from fieldbus, adapted to convert the data messages to TTL signals and adapted to be powered by the power supply. The data transmitter according to the present invention is for example a transmitter such as for example the transmitter MAX485 from MAXIM integrated adapted to convert the TTL signals into differential signals and adapted to transmit the differential signals comprising the data messages to the data acquisition system and to be powered by the power supply. Alternatively, the data transmitter of the cable assembly is a LAN8720A.

According to an optional aspect of the invention, the isolation module is further adapted to electrically isolate the data transmitter from the fieldbus such that the isolation module prevents the data transmitter from transmitting messages to the fieldbus, thereby preventing the data acquisition from transmitting messages to the fieldbus.

According to an optional aspect of the invention, the fieldbus is a Multifunction Vehicle Bus and/or a vehicle fieldbus comprising one of the following protocols:

Factory Instrumentation Protocol or FIP or WorldFIP;
Profibus;
Profinet;
LonWorks;
Controller Area Network or CANopen;
SAE J1708;
SAE J1939;
MODBUS;
Wire Train Bus or WTB.

Fieldbus according to the present invention is an industrial network system for real-time distributed control. Fieldbus couples a plurality of instruments, devices, components and systems on board a train. Fieldbus works on a network structure which typically allows daisy-chain, star, ring, branch, and tree network topologies. Previously, computers were connected using serial connections, for example RS-232, by which only two devices could communicate. Fieldbus requires only one communication point at the controller level and allows a plurality of analog and digital points on board a train or rolling stock to be connected at the same time. This reduces both the length of the cable required and the number of cables required. There existed initially an initial form of the IEC 61158 standard for Fieldbus with eight different protocol sets called "Types", but then the fieldbus types were reorganized into Communication Profile Families, also referred to as CPFs, for example Profibus.

The Train Communication Network, also referred to as TCN, is a hierarchical combination of two fieldbus for data transmission within trains. It comprises the Multifunction Vehicle Bus, also referred to as MVB, inside each vehicle and the Wire Train Bus, also referred to as WTB, to connect different railway cars.

The wire train bus or WTB has been designed for international passenger trains with variable composition. The medium comprises a duplicated shielded twisted pair cable, which runs in the UIC cables between the vehicles. The connector between the vehicles is the 18-pole UIC connector. The standard connector for the WTB nodes is a DIN 9 pin connector. The physical level uses RS-485 levels at 1 Mbit/s data rate. The encoding uses a Manchester II code and a HDLC frame protocol with proper voltage balancing to avoid DC components in the galvanic isolation transformers. The Manchester decoder uses a phase/quadrature demodulation, except for RS-485 that operates with zero-crossings, which allows to span 750 m under worst-case conditions, especially when only the two extremity vehicles are equipped, as is the case with multiple traction for freight trains. A unique property of the WTB is the train inauguration in which the newly connected vehicles receive an address in sequence and can identify the vehicle side (called port and starboard like in the marine) so that doors open on the correct side. Up to 32 addresses can be dynamically allocated. When two train compositions join, the addresses are reallocated to form a new composition of vehicles with a sequential address. Vehicles without WTB node are not counted. The frames have a maximum payload of 1024 bits. The WTB operates cyclically to provide deterministic operation, with a period of 25 ms, used mainly for the traction control. The WTB also supports sporadic data transmission for diagnostics. The content of the periodic and sporadic frames is governed by the UIC 556 standard. Since frame size is limited, a version of TCP with reduced overhead was used for message segmenting and reassembly, that at the same time allows to cope with changes in composition, called Real-Time Protocol or RTP.

The MVB connects individual nodes within a vehicle or in a closed train set. When the fieldbus is a Multifunction Vehicle Bus, the cable assembly is available in three standards: Electrical Medium Distances, also referred to as EMD, which uses shielded twisted pair with RS-485 transmitters and transformers for galvanic isolation and for a length of the cable assembly up until a few hundred meters, Electrical Short Distances, also referred to as ESD, which uses a simple backplane wiring without galvanic isolation and for a length of the cable assembly up until a few tens meters, and lastly optical lines for very long communication distances and galvanic insulation. The MVB operates with 1.5 Mbps via twisted wire pairs and via optical fibers. It is structured with two channels to guarantee a higher reliability of transmission. These two channels are separated in passages from one wagon to another. The transmission of the data messages on the MVB is controlled by several bus managers or only by one bus manager. With this, the data transfer is asynchronous. For the system, this means that each bus manager has its own clock. The MVB is based on the master-slave principle. The master can be coupled to the bus at any location.

According to the present invention, the data messages pass periodically on the fieldbus and/or pass sporadically on the fieldbus. For example, the MVB principally transfers two types of data: process variables, i.e. periodic data, and messages, i.e. sporadic data. Process variables are short data, such as for example data messages comprising of 16, 32, 64, 128 or 256 bits, that provide information about the status of the train, for example its velocity. Alternatively, the data messages comprise 256 bits. The process variables are transported in cycles, so as to guarantee low latency, namely below for example 15 ms within a railway car, and below for example 100 ms within a train. Messages are longer information and enable analysis for example of the network management. The message payload can vary in range from a few bytes up to megabytes. The messages are sent according to demand, without time constraints. Periodic and sporadic data messages are passing on the same bus in the devices, but they are transmitted alternatively and never together. Process data messages are transmitted to all the devices on the bus. The master is responsible for polling regularly slave by sending a 'Master Frame'. The slaves monitor the bus, and when one slave gets a Master Frame requesting a parameter it owns, the slave sends back a message comprising the data requested.

The Factory Instrumentation Protocol or FIP is a standardized field bus protocol defined in the European Standard EN50170. A number of manufacturers from Japan and America merged with FIP to the WorldFIP standardization group. The closest cousin of the FIP family can be found today in the Wire Train Bus for train coaches. However, a specific subset of WorldFIP, known the FIPIO protocol, can be found widely in machine components.

A Controller Area Network bus, also referred to as CAN bus, is a robust vehicle bus standard designed to allow microcontrollers and devices to communicate with each other in applications without a host computer. It is a message-based protocol. As the CAN standard does not include tasks of application layer protocols, such as flow control, device addressing, and transportation of data blocks larger than one message, and above all, application data, many implementations of higher layer protocols were created. Among these implementations are CANopen—EN 50325-4. CANopen is a communication protocol and device profile specification for embedded systems used in automation. In terms of the OSI model, CANopen implements the layers above and including the network layer. The CANopen standard consists of an addressing scheme, several small communication protocols and an application layer defined by a device profile. The communication protocols have support for network management, device monitoring and communication between nodes, including a simple transport layer for message segmentation/desegmentation. The lower level protocol implementing the data link and physical layers is usually Controller Area Network, although devices using some other means of communication, such as for example Ethernet Powerlink, EtherCAT can also implement the CANopen device profile.

Local operating network, also referred to as LonWorks, is a networking platform specifically created to address the needs of control applications. The platform is built on a protocol created by Echelon Corporation for networking devices over media such as twisted pair, powerlines, fiber optics, and RF. Two physical-layer signaling technologies, twisted pair "free topology" and power line carrier, are typically included in each of the standards created around the LonWorks technology. The two-wire layer operates at 78 kbit/s using differential Manchester encoding, while the power line achieves either 5.4 or 3.6 kbit/s, depending on frequency. Additionally, the LonWorks platform uses an affiliated Internet protocol tunneling standard ISO/IEC 14908-4 in use by a number of manufacturers to connect the devices on previously deployed and new LonWorks platform-based networks to IP-aware applications or remote network-management tools. Many LonWorks platform-based control applications are being implemented with some sort of IP integration, either at the UI/application level or in the controls infrastructure. This is accomplished with Web services or IP-routing products available in the market.

SAE J1708 is a standard used for serial communications between Electronic Control Units on a heavy duty vehicle and also between a computer and the vehicle. With respect to Open System Interconnection model or OSI, J1708 defines the physical layer. Common higher layer protocols that operate on top of J1708 are SAE J1587 and SAE J19226. The standard defines a 2-wire 18 gauge wire cable that operates at 9600 bit/s. A message is composed of up to 21 characters, unless the engine is stopped and the vehicle is not moving in which case transmitters are allowed to exceed the 21 byte max message length. Messages start with a Message ID or MID character and finish with a checksum at the end. Characters are transmitted in the common 8N1 format. The hardware utilized are RS-485 transceivers wired for open collector operation through the use of a pullup and pulldown of the separate data lines. Transmission is accomplished by controlling the driver enable pin of the transceiver. This method allows multiple devices to share the bus without the need for a single master node. Collisions are avoided by monitoring the bus while transmitting the MID to ensure that another node has not simultaneously transmitted a MID with a higher priority.

SAE J1939 is the vehicle bus recommended practice used for communication and diagnostics among vehicle components. SAE J1939 is used in the commercial vehicle area for communication throughout the vehicle, with the physical layer defined in ISO 11898. SAE J1939 defines five layers in the seven-layer OSI network model, and this includes the Controller Area Network ISO 11898 specification using only the 29-bit/"extended" identifier for the physical and data-link layers. Under J1939/11 and J1939/15, the data rate is specified as 250 kbit/s, with J1939/14 specifying 500 kbit/s. All J1939 packets, except for the request packet, contain eight bytes of data and a standard header which contains an index called Parameter Group Number or PGN, which is embedded in the message's 29-bit identifier. A PGN identifies a message's function and associated data.

Modbus is a serial communications protocol which enables communication among many devices connected to the same network. Modbus is often used to connect a supervisory computer with a remote terminal unit in supervisory control and data acquisition systems. Each device intended to communicate using Modbus is given a unique address. In serial and MB+ networks, only the node assigned as the Master may initiate a command. On Ethernet, any device can send out a Modbus command, although usually only one master device does so. A Modbus command contains the Modbus address of the device it is intended for. Only the intended device will act on the command, even though other devices might receive it. All Modbus commands comprise checksum information, to allow the recipient to detect transmission errors.

According to an optional aspect of the invention, the data listener is coupled to the fieldbus.

This way, the cable assembly is plugged in on the fieldbus between the fieldbus and the data acquisition system such that the data listener is coupled to the fieldbus. The isolation module isolates the data transmitter such that the interference of the cable assembly on the data messages passing on the fieldbus is minimized.

According to an optional aspect of the invention, the isolation module is electrically interposed between said data transmitter and said data listener, thereby electrically isolating said data transmitter from said fieldbus.

This way, the cable assembly is plugged in on the fieldbus between the fieldbus and the data acquisition system such that the isolation module isolates the data transmitter from the fieldbus such that the interference of the cable assembly on the data messages passing on the fieldbus is minimized.

According to an optional aspect of the invention, the cable assembly is further adapted to covertly listen in on the data messages passing on the fieldbus, thereby allowing the data messages to pass on the fieldbus.

The data listener is further adapted to covertly listen in on the data messages passing on the fieldbus, thereby allowing the data messages to pass on the fieldbus. This way, the integrity of the data messages transmitted over the fieldbus remains. The cable assembly allows the data acquisition system to read the data messages passing on the fieldbus without interfering with the fieldbus and without modifying the data messages.

According to an optional aspect of the invention:

the fieldbus comprises two data message lines, both data message lines being adapted to carry a redundant differential signal; and the data listener only listens in on the redundant differential signal only from one of the data message lines.

According to an optional aspect of the invention, the data listener does not listen in on the redundant differential signal from the other data message line, such that the redundant differential signal on the other data message line of the fieldbus is not listened in by the cable assembly.

The use of two data message lines in the fieldbus guarantees a higher reliability of the transmission of the data messages. Both data message lines carry the same redundant differential signal comprising one or more data messages. In other words, each data message lines comprises two channels on which a redundant differential signal comprising one or more data messages is transmitted. The data listener only listens in on the redundant differential signal from one of the two data message lines. This way, in the case that a short-circuit or a failure on the one of the two data message lines would occur due to the coupling of the cable assembly and/or due to the coupling to the data acquisition system via the cable assembly which would render the data message line obsolete, the data messages could still be passing on the fieldbus via the second of the two data message lines. In other words, the integrity of the communication on the fieldbus is guaranteed by the fact that the cable assembly is only coupled to one of the two data message lines, thereby leaving the other data message line in its original state. This further minimizes the interference of the cable assembly with the fieldbus. This further guarantees the integrity of the data transmission of the data messages passing on the fieldbus form railway assets or devices to the rolling stock and ensures the normal functioning of the rolling stock even when one of the data message lines is damaged or defective or faulty.

According to an optional aspect of the invention, the data listener is further adapted to convert the redundant differential signal into a TTL signal and to send the TTL signal to the isolation module which is adapted to transmit the TTL signal to the data transmitter.

According to an optional aspect of the invention, the data transmitter is further adapted to convert the TTL signal into a differential signal and to send the differential signal to the data acquisition system.

A differential signal is transmitted by the data transmitter to the data acquisition system. This way, the differential signal can easily be processed by the data acquisition system. For example, the differential signal is compatible with CAN, or RS-485, etc. Alternatively, the data listener converts the redundant differential signal into Ethernet.

According to an optional aspect of the invention, the isolation module is a galvanic isolation module.

According to an optional aspect of the invention, the galvanic isolating module comprises a ground isolating unit, adapted to access a ground of the two data message lines; and the data listener is further adapted to ground the redundant differential signal according to the ground.

For example, in the case of an ESD compatible cable assembly, the data listener of the cable assembly listens in on the data messages by coupling with only one of the data message lines while being electrically isolated from the fieldbus by the isolation module and the galvanic isolation module is further coupled to the ground of the fieldbus. This way, the cable assembly prevents a loop of mass. The isolation module of the cable assembly isolates the data transmitter by using the ground of the fieldbus. The isolation module provides for example a 5 kVolt isolation. Routing rules and clearances were followed to ensure 500 Volt of isolation between the two channels of each of the two data message lines. Additionally, board stackup and differential pair rules were followed to ensure impedance of on-board routing was within 10% of the nominal 120 Ohm impedance to avoid signal integrity issues. Care has been taken to make sure that the load introduced on the fieldbus is as small as possible, regardless of the cable assembly being enabled (powered) or disabled (not powered). In this case, the load is 96 kOhms, which introduces a load smaller than 1/64 of a typical railway device. Attenuation between the input of the data listener and the output of the data transmitter was measured to be lower than 1 dB, with no jitter.

For example, in the case of an EMD compatible cable assembly, the data listener of the cable assembly listens in on the data messages from only one of the data message lines. The isolation module of the cable assembly then comprises an isolation transformer which is used to isolate on-board circuitry from the fieldbus. Routing rules and clearances were followed to ensure 500 Volt of isolation between the two channels of each of the two data message lines. Additionally, board stackup and differential par rules were followed to ensure impedance of on-board routing was within 10% of the nominal 120 Ohm to avoid signal integrity issues. Care has been taken to make sure that the load introduced on the fieldbus is as small as possible, regardless of the cable assembly being enabled (powered) or disabled (not powered). In this case, the load is 96 kOhms, which introduces a load smaller than 1/64 of a typical railway device. Attenuation between the input of the data listener and the output of the data transmitter was measured to be lower than 1 dB, with no jitter.

According to an optional aspect of the invention, the cable assembly further comprises a power input filter.

This way, no direct conduction path is permitted by the isolation module. In other words, the isolation module applies a principle of isolating functional sections of the electrical system comprising the fieldbus and the cable assembly, thereby preventing current to flow from the cable assembly to the fieldbus. This way, the noise generated by the power supply of the cable assembly is filtered away to minimize the propagation of the noise generated by the power supply of the cable assembly to the fieldbus by electromagnetic coupling. The power supply of the cable assembly further comprises a Zener diode to protect the cable assembly and the fieldbus against voltage peaks. Energy or information can still be exchanged between the fieldbus and the cable assembly by other means, such as for example capacitance, induction or electromagnetic waves, or by optical, acoustic or mechanical means. Galvanic isolation is used where the cable assembly and the fieldbus must communicate, but their grounds may be at different potentials. It is an effective method of breaking ground loops by preventing unwanted current from flowing between two units sharing a ground conductor. Galvanic isolation is also used for safety, preventing accidental current from reaching ground through a person's body holding the cable assembly. The galvanic isolation module typically uses transformers that may be integrated in a single chip, such as for example ADM2682 from Analog Devices. Alternatively, the isolation module comprises optocouplers such as for example 6N137 from VISHAY.

According to an optional aspect of the invention, the data transmitter comprises an input impedance larger than 50 kOhms.

This way, the data transmitter is further isolated from the fieldbus as it demonstrates an impedance higher than the impedance of the fieldbus. For example, the impedance of the data transmitter is 60 kOhms, or 75 kOhms, or 100 kOhms, etc. and the impedance of the fieldbus is 100 or 120 Ohms. Input and output connectors shield are internally connected through the PCB and the metallic case. The output cable assembly shield is crimped to the case. All shields are connected together.

According to a second aspect of the invention, there is provided a method for providing a data acquisition system with data messages passing on a fieldbus of rolling stock, the method comprising the steps of:

listening in on the data messages passing on the fieldbus;

transmitting the data messages to the data acquisition system; and electrically isolating the data acquisition system from the fieldbus such that the data acquisition system is limited by the isolation module to only listening in on the data messages passing on the fieldbus.

The method according to the present invention allows remote and real-time and fail-safe diagnostic of a condition of rolling stock. In particular the method according to the present invention allows remote and real-time monitoring of the performance of railway assets and components on board rolling stock, such as for example the battery monitoring system of a locomotive, and/or the bearing monitoring system of a locomotive or a railway car, and/or the Train Control & Management System of a train, also referred to as TCMS, and/or the engine remote diagnostic system of a locomotive, and/or the energy remote monitoring system of a train, etc. The data messages passing on the fieldbus comprise information indicative for a status of one or more devices coupled to the fieldbus. The monitoring of the performance of the devices and/or the diagnostic of the state of the devices on board rolling stock is performed continuously over time and can therefore be used to support for example a driver of a locomotive in real-time. This way, an accurate state of the rolling stock can be characterized by the data acquisition system and transient events occurring on board the rolling stock can be detected by the data acquisition system. The use of the method according to the present invention can therefore support an operator or a technician foresee a shortage or failure of one or more of the devices on board the train. Additionally, as the method according to the present invention listens in on a fieldbus to which a plurality of devices is coupled, the method allows the data acquisition system to become one centralized Internet Of Things platform from which all the assets and components coupled to the fieldbus can be tested and characterized. This uniformed platform allows the centralization of the history of the monitoring and the diagnostic of the rolling stock, for example in the cloud, and renders accessing data from rolling stock widely accessible to operational staff and experts who can leverage themselves with data analysis software.

The method according to the present invention covertly listens in on the communication passing on a fieldbus coupling a plurality of devices to the rolling stock. There is no bandwidth limitation or data down-sampling with the method according to the present invention. The listening in is performed while being electrically isolated from the fieldbus. The method according to the present invention is then totally passive on the bus and collects an electronic copy of the data messages passing on the fieldbus without interfering with the data messages passing on the fieldbus. In other words, the method according to the present invention collects an electronic copy of the data messages passing on the fieldbus in a non-intrusive manner on the fieldbus without affecting the original data messages passing on the fieldbus and without affecting the characteristics or the configurations of the fieldbus themselves. The method then transmits the listened in data messages to the data acquisition system, for example over a high-speed data link. Preferably, the data acquisition system is not able to write commands and/or send data messages on the fieldbus. The method according to the present invention therefore protects the fieldbus and the coupled railway assets and devices from potential shortcuts, over voltages, pin reversing, etc. that would occur at the side of the data acquisition system. The method further complies with safety requirements according to both national and international standards and directives.

In other words, the method according to the present invention prevents the data acquisition system from writing commands on the fieldbus and/or from sending or transmitting data messages or any other type of messages to the fieldbus. The method according to the present invention only intercepts data messages passing on a fieldbus without interfering with the fieldbus and without modifying either the data messages that are intercepted or the data messages passing on the fieldbus. In other words, the data messages that are read from the fieldbus according to the method according to the present invention are not interfered with on the fieldbus. This way, the integrity of the data messages transmitted over the fieldbus remains. The method according to the present invention allows the data acquisition system to read the data messages passing on the fieldbus without interfering with the fieldbus and without modifying the data messages. In other words, the method according to the present invention allows the data acquisition system to receive the data messages from the fieldbus without interfering with the data messages passing on the fieldbus and without modifying the data messages passing on the fieldbus.

This way, the method according to the present invention prevents any unwanted intrusion on the fieldbus. For example, the method according to the present invention prevents any unwanted hacking intruder on the fieldbus to write commands and/or to transmit and/or send data messages or any other type of messages on the fieldbus which could jeopardize the correct and safe functioning of the rolling stock and which could endanger the integrity of the rolling stock and/or of its load.

BRIEF DESCRIPTION OF THE DRAWINGS

FIG. 1 schematically illustrates an embodiment of a cable assembly according to the present invention.

DETAILED DESCRIPTION OF EMBODIMENT(S)

According to an embodiment shown in FIG. 1, a cable assembly 1 according to the present invention is coupled to a fieldbus 3 and positioned between a fieldbus device 30 coupled to the fieldbus 3 and a data acquisition system 2 of rolling stock 10. The fieldbus 3 is a Multifunction Vehicle Bus or a vehicle fielbus comprising FIP or Profibus or CAN or Profinet or LonWorks. The cable assembly comprises a data listener 101, a data transmitter 102 and an isolation module 103. The cable assembly 1 is coupled to the fieldbus device 30 via a connector 20. The connector 20 is for example a 9 pins D-Sub type of connector. According to an alternative embodiment, the connector 20 is a Deutsch HD10-9-96P type of connector. According to a further alternative embodiment, the connector 20 is a M12 type of connector. The data listener 101 listens in on data messages 300 passing on the fieldbus 3. The data listener 101 covertly listens in on the data messages 300 passing on the fieldbus 3, thereby allowing the data messages 300 to pass on the fieldbus 3 between the connector 20 and the connector 21 of the cable assembly 1. The connector 21 is for example a 9 pins D-Sub type of connector. According to an alternative embodiment, the connector 21 is a RJ-45 type of connector. According to a further alternative embodiment, the connector 21 is a Deutsch DT04-4P type of connector. The fieldbus comprises two data message lines 31;32, both data message lines 31;32 carrying a redundant differential signal 302. The data listener 101 is coupled to only one of the two data message lines 31;32, thereby listening in on the redundant differential signal 302 only from one of the two data message lines 31;32. The data listener 101 is not coupled to the other of the two data message lines 31;32. In other words, the redundant differential signal 302 on the other of the two data message lines 31;32 is not listened in by the cable assembly 1. The data listener 101 converts the redundant differential signal 302 into a TTL signal 303 and sends the TTL signal 303 to the isolation module 103. The isolation module 103 is electrically interposed between the data listener 101 and the data transmitter 102. The data listener 101 listens in only on the redundant differential signal 302 only from one of the two data message lines 31;32. The data listener 101 does not listen in on the other of the two data message lines 31;32. In other words, the redundant differential signal 302 on the other of the two data message lines 31;32 is not listened in by the cable assembly 1. The isolation module 103 electrically isolates the data listener 101 from the data transmitter 102 and sends the TTL signal 303 received from the data listener 101 to the data transmitter 102. The data transmitter 102 converts the TTL signal 303 in to a differential signal 304 and sends the differential signal 304 to the data acquisition system 2. The data transmitter 102 is coupled to the data acquisition system 2 via for example a high-speed data link 301. The high-speed data link 301 is for example a link adapted for speed transfers of 1.5M bits/second. According to an alternative embodiment, the high-speed data link 301 is for example a link adapted for speed transfers of 10M bits/second. According to an alternative embodiment, the data transmitter 102 is coupled to the data acquisition system 2 via 100 or 120 Ohms impedance controlled multi pair cable. The isolation module 103 comprises a galvanic isolation module. Optionally, the galvanic isolation module comprises a ground isolating unit 104 which accesses the ground 33 of the fieldbus 3. In other words, the ground isolating unit 104 accesses the ground 33 of the data message lines 31;32 and grounds the redundant differential signal 302 according to the ground 33, thereby electrically isolating the data transmitter 102 from the data listener 101. The cable assembly 1 further comprises a input filter 105. The power input filter 105 for example comprises a ferrite and capacitors. The power input filter 105 receives power 4 from the data acquisition system 2 and the power input filter 105 powers in return the data transmitter 102 and the isolation module 103 via power 4.

Although the present invention has been illustrated by reference to specific embodiments, it will be apparent to those skilled in the art that the invention is not limited to the details of the foregoing illustrative embodiments, and that the present invention may be embodied with various changes and modifications without departing from the scope thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein. In other words, it is contemplated to cover any and all modifications, variations or equivalents that fall within the scope of the basic underlying principles and whose essential attributes are claimed in this patent application. It will furthermore be understood by the reader of this patent application that the words "comprising" or "comprise" do not exclude other elements or steps, that the words "a" or "an" do not exclude a plurality, and that a single element, such as a computer system, a processor, or another integrated unit may fulfil the functions of several means recited in the claims. Any reference signs in the claims shall not be construed as limiting the respective claims concerned. The terms "first", "second", third", "a", "b", "c", and the like, when used in the description or in the claims are introduced to distinguish between similar elements or steps and are not necessarily describing a sequential or chronological order. Similarly, the terms "top", "bottom", "over", "under", and the like are introduced for descriptive purposes and not necessarily to denote relative positions. It is to be understood that the terms so used are interchangeable under appropriate circumstances and embodiments of the invention are capable of operating according to the present invention in other sequences, or in orientations different from the one(s) described or illustrated above.

The invention claimed is:

1. A cable assembly for providing a data acquisition system with data messages passing on a fieldbus of rolling stock, said cable assembly comprising:

a data listener adapted to listen in on said data messages passing on said fieldbus;

a data transmitter adapted to transmit said data messages to said data acquisition system; and an isolation module adapted to electrically isolate said data transmitter from said data listener and from said fieldbus, thereby electrically isolating said data acquisition system from said fieldbus such that said data acquisition system is limited by said isolation module to only listening in on said data messages passing on said fieldbus;

wherein:

said fieldbus comprises two data message lines, both data message lines being adapted to carry a redundant differential signal;

said data listener only listens in on said redundant differential signal only from one of said data message lines; and said data listener is further adapted to convert said redundant differential signal into a TTL signal and to send said TTL signal to said isolation module which is adapted to transmit said TTL signal to said data transmitter.

2. The cable assembly according to claim 1, wherein said isolation module is further adapted to electrically isolate said data transmitter from said data listener and from said fieldbus such that said isolation module prevents said data transmitter from transmitting messages to said fieldbus, thereby preventing said data acquisition system from transmitting messages to said fieldbus.

3. The cable assembly according to claim 1, wherein said fieldbus is a Multifunction Vehicle Bus and/or a vehicle fieldbus comprising one of the following protocols:

Factory Instrumentation Protocol or FIP or WorldFIP;
Profibus;
Profinet;
LonWorks;
Controller Area Network or CANopen;
SAE J1708;
SAE J1939;
MODBUS;
Wire Train Bus or WTB.

4. The cable assembly according to claim 1, wherein isolation module is electrically interposed between said data listener and said data transmitter, thereby electrically isolating said data transmitter from said data listener and from said fieldbus.

5. The cable assembly according to claim 1, wherein said cable assembly is further adapted to covertly listen in on said data messages passing on said fieldbus, thereby allowing said data messages to pass on said fieldbus.

6. The cable assembly according to claim 1, wherein said data listener does not listen in on said redundant differential signal form the other data message line, such that said redundant differential signal on the other data message line of said fieldbus is not listened in by said cable assembly.

7. The cable assembly according to claim 1, wherein said data transmitter is further adapted to convert said TTL signal into a differential signal and to send said differential signal to said data acquisition system.

8. The cable assembly according to claim 1, wherein said isolation module is a galvanic isolation module.

9. The cable assembly according to claim 1, wherein said data transmitter comprises an input impedance larger than 50 kOhms.

10. The cable assembly according to claim 8, wherein said galvanic isolating module comprises a ground isolating unit, adapted to access a ground of said two data message lines; and wherein said data listener is further adapted to ground said redundant differential signal according to said ground.

11. The cable assembly according to claim 10, wherein said cable assembly further comprises a power input filter.

12. A method for providing a data acquisition system with data messages passing on a fieldbus of rolling stock, said method comprising the steps of:

listening in on said data messages passing on said fieldbus by a data listener;

transmitting said data messages to said data acquisition system; and electrically isolating said data acquisition system from said fieldbus such that said data acquisition system is limited by said isolation module to only listening in on said data messages passing on said fieldbus;

wherein:

said fieldbus comprises two data message lines, both data message lines being adapted to carry a redundant differential signal;

said data listener only listens in on said redundant differential signal only from one of said data message lines; and said data listener is further adapted to convert said redundant differential signal into a TTL signal and to send said TTL signal to said isolation module which is adapted to transmit said TTL signal to said data transmitter.

* * * * *